US010087497B2

(12) United States Patent
Fennen et al.

(10) Patent No.: US 10,087,497 B2
(45) Date of Patent: Oct. 2, 2018

(54) PROCESS FOR RETANNING LEATHER

(71) Applicant: TFL LEDERTECHNIK GMBH, Weil am Rhein (DE)

(72) Inventors: Jens Fennen, Grenzach-Wyhlen (DE); Eric Kientz, Ferrette (FR); Florian Döppert, Schliengen (DE); Nina Schulte, Freiburg (DE)

(73) Assignee: TFL LEDERTECHNIK GMBH, Weil am Rhein (DE)

( * ) Notice: Subject to any disclaimer, the term of this patent is extended or adjusted under 35 U.S.C. 154(b) by 0 days.

(21) Appl. No.: 14/904,722

(22) PCT Filed: Jul. 25, 2014

(86) PCT No.: PCT/EP2014/066066
§ 371 (c)(1),
(2) Date: Jan. 13, 2016

(87) PCT Pub. No.: WO2015/011272
PCT Pub. Date: Jan. 29, 2015

(65) Prior Publication Data

US 2016/0160301 A1 Jun. 9, 2016

(30) Foreign Application Priority Data

Jul. 26, 2013 (EP) ..... 13178154

(51) Int. Cl.
*C14C 3/28* (2006.01)
*C14C 3/10* (2006.01)
(Continued)

(52) U.S. Cl.
CPC ..... *C14C 3/28* (2013.01); *C14C 3/10* (2013.01); *C14C 3/14* (2013.01); *C14C 3/20* (2013.01);
(Continued)

(58) Field of Classification Search
CPC .... C14C 3/10; C14C 3/20; C14C 3/22; C14C 3/28; C14C 11/006; C14C 9/02; C14C 3/14; D06P 3/00; C09D 175/04; C08L 75/08
See application file for complete search history.

(56) References Cited

U.S. PATENT DOCUMENTS 5,368,609 A 11/1994 Inoue
2009/0205142 A1* 8/2009 Vorlander ..... C14C 3/06 8/94.2

FOREIGN PATENT DOCUMENTS

| | | |
|---|---|---|
| EP | 1 279 746 | 1/2003 |
| MX | 2007009336 | 9/2008 |
| WO | 2008/043643 | 4/2008 |

OTHER PUBLICATIONS

International Search Report dated Sep. 2, 2014 in International Application No. PCT/EP2014/066066.
(Continued)

*Primary Examiner* — Eisa B Elhilo
(74) *Attorney, Agent, or Firm* — Wenderoth, Lind & Ponack, L.L.P.

(57) ABSTRACT

The present invention is directed to a process for retanning leather comprising the steps of: a) providing tanned or pre-tanned leather b) treating the tanned leather of step a) with a composition comprising hollow microspheres, preferably as an aqueous composition, the hollow microspheres have a true density of from 0.01 to 0.10 g/cm$^3$ (25° C.) and/or a bulk density of the dry powder of 0.005 to 0.06 g/cm$^3$ (25° C.), c) drying, whereby the temperature of the leather during drying does not exceed 75° C. as well as to leather obtained by said process.

22 Claims, 1 Drawing Sheet

SEM analysis of leather prepared according to example 7

(51) Int. Cl.

| | |
|---|---|
| ***C14C 3/20*** | (2006.01) |
| ***C14C 3/22*** | (2006.01) |
| ***C14C 9/02*** | (2006.01) |
| ***C14C 11/00*** | (2006.01) |
| ***C14C 3/14*** | (2006.01) |
| ***D06P 3/00*** | (2006.01) |

(52) U.S. Cl.
CPC ..... *C14C 3/22* (2013.01); *C14C 9/02* (2013.01); *C14C 11/006* (2013.01); *D06P 3/00* (2013.01)

(56) References Cited

OTHER PUBLICATIONS

Written Opinion of the International Searching Authority dated Sep. 2, 2014 in International Application No. PCT/EP2014/066066.

* cited by examiner

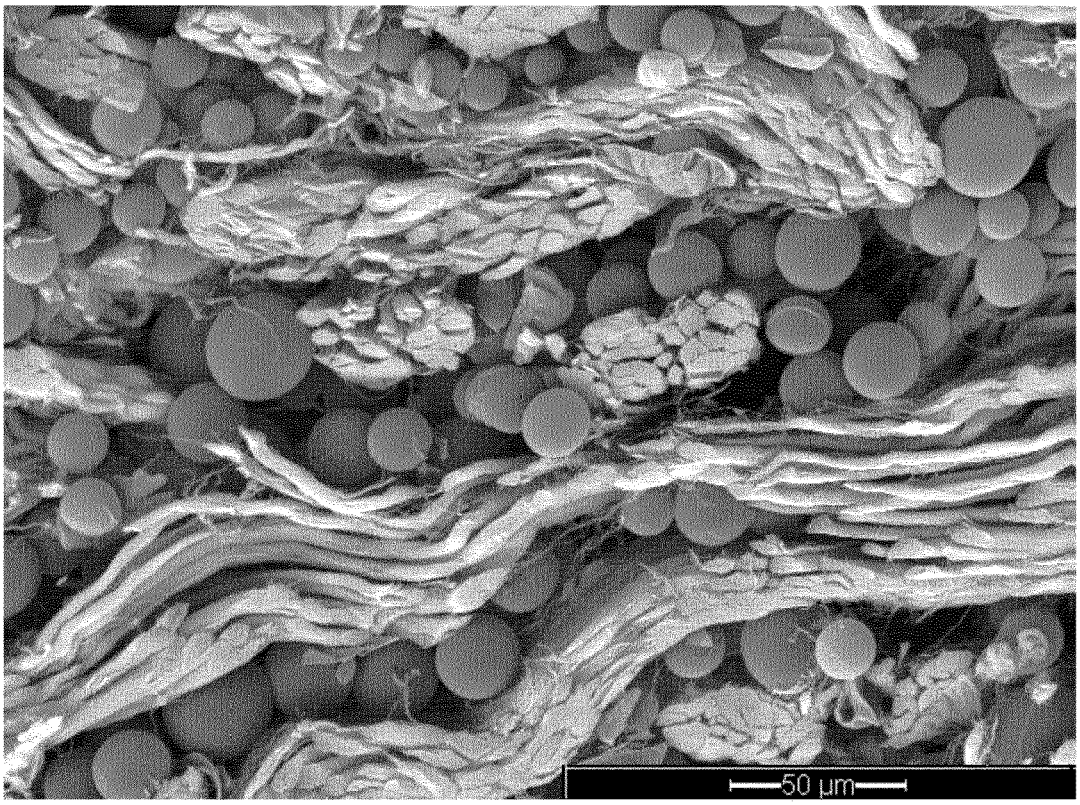
SEM analysis of leather prepared according to example 7

PROCESS FOR RETANNING LEATHER

The present invention is directed to a process for retanning leather as well as leather produced thereby.

The use of hollow microspheres in the process of retanning leather has been described in the art. All of the processes have in common that the hollow microspheres used are filled with a propellant which expand the microspheres due to a heat treatment step.

U.S. Pat. No. 5,368,609 relates to a softening filler for leather comprising thermo-expansible microcapsules of thermoplastic resin. By entering the spaces between the leather fibers during impregnation, followed by heat treatment where the microcapsules expand, the spaces are expanded making the leather soft and voluminous.

EP 1 279 746 A1 refers to a process for the preparation of leather comprising a step of adding to wet skin thermally expandable microspheres. The thermally expandable microspheres used have a thermoplastic polymer shell encapsulating a propellant. Said thermally expandable microspheres are added to wet skin, followed by a step of heat treatment at a temperature sufficient to result in expansion of the microspheres captured in the skin. During heat treatment the shell softens and gives way to the internal pressure of the evaporating propellant, resulting in significant expansion of the microspheres, normally about 2 to about 5 times their diameter. The aim of encapsulating and expanding microspheres within the skin is to give more substance (thicker leather) as well as to increase the area yield of skin. However, due to the heat treatment step the leather is detrimentally affected, since it becomes slightly brittle.

Also WO 2008/043643 A1 refers to a process for retanning leather using hollow microspheres wherein a tanned leather is treated in aqueous liquor in the presence of hollow microspheres filled with a blowing agent. The leather obtained is dried after further optional retanning steps and treated with steam and infra-red at 80 to 120° C. Due to the treatment with steam the blowing agent present in the microspheres expands resulting in expansion of the microspheres of 2 to 5 times their diameter. Also with this process, due to the heat treatment step the leather is detrimentally affected, since it becomes slightly brittle. The very short exposure time to steam and IR may also carry the risk to not fully expand the microspheres in the cross-section of the leather.

The hollow microspheres used in WO 2008/043643 A1 are unexpanded microspheres being filled with a blowing agent. Consequently, the true density and the bulk density of a dry powder of such unexpanded microspheres at 25° C. are respectively in the range 1.0 to 1.2 g/cm$^3$ (true density) and 0.4 to 0.8 g/cm$^3$ (bulk density). The true density can be determined with a helium pycnometer and is the density of the microspheres as such. The bulk density is determined by measuring the mass of a defined volume of the dry powder, preferably according to ISO 8460, section 1 (determination of free-flow bulk-density).

However, the aforementioned processes have several drawbacks. First of all, due to the heat treatment necessary for expanding the microspheres the leather becomes slightly brittle, especially pronounced on chrome free leather. Additionally a large amount of microspheres is needed and the process for expanding microspheres is complicated with high energy consumption. The heat treatment processes also offer the risk to not have a complete and uniform particle expansion through the leather cross-section. Electron scanning microscopy shows that some particles have been deformed or even destroyed after the steam or IR expansion treatment.

Thus, there is a need in the art for a process providing the following benefits:

First of all a simple process which allows tanneries to avoid complicated and costly processes to expand microspheres with steam or an infra-red oven has to be provided. Moreover, the improved process shall provide a significant effect of filling with a substantially lower quantity of hollow microspheres compared to the state of the art. Additionally, a more uniform distribution through the leather cross-section is to be provided, whereby the leathers obtained have a good overall fullness and mainly good selective filling in the flanks, thus giving articles with significantly higher cutting yield. Also, the customary process of leather making involves a high amount of retanning and fatliquoring agents as well as dyestuffs. It is therefore desirable to reduce the required amount of these products without compromising the leather properties. This will lead additionally to the reduction of the specific weight of the leather.

The technical problem underlying the present invention is solved by a process for retanning leather comprising the steps of:

a) providing tanned or pre-tanned leather
b) treating the tanned leather of step a) with a composition comprising hollow microspheres, preferably as an aqueous composition, the hollow microspheres have a true density of from 0.01 to 0.10 g/cm$^3$ (25° C.) and/or a bulk density of the dry powder of 0.005 to 0.06 g/cm$^3$ (25° C.).
c) drying, whereby the temperature of the leather during drying does not exceed 75° C.

The true density can be determined with a helium pycnometer and is the density of the microspheres as such. Alternatively, the true density can be determined as the quotient of the median mass of the hollow microspheres with the median volume of the hollow microspheres (median mass hollow microspheres/median volume hollow microspheres (g/cm$^3$)).

The bulk density is determined by measuring the mass of a defined volume of the dry powder, preferably according to ISO 8460, section 1 (determination of free-flow bulk-density).

In the context of the present invention tanned or pretanned leather encompasses chrome-tanned leather. Leather pretanned without chromium and vegetable-pretanned leather can be used as such. Leather containing mineral tanning agent or leather free of mineral tanning agent is preferred. To prepare the leather used in step a), skins and hides of all kind of animals can be used.

In step b) the amount of hollow microspheres used preferably is 0.05 to 1.0% by weight, based on dry weight of the leather (assuming shaved leather having a 50 wt-% water content). Preferably, in step b) the amount of hollow microspheres used is 0.1 to 0.7% by weight Preferably, the composition used in step b) is an aqueous composition having a solid content of hollow microspheres from 0.5 to 15% by weight.

The hollow microspheres have a shell and an interior (cavity). The shell is preferably composed of an organic polymer or copolymer. Monomers suitable for the synthesis of the shell of the hollow microspheres are in particular monomers containing nitrile groups, such as acrylonitrile, methacrylonitrile, fumaronitrile and crotononitrile, acrylates or methacrylates, such as ethyl acrylate, methyl acrylate, methyl methacrylate, isobornyl methacrylate and hydroxyethyl methacrylate, vinyl halides, such as vinyl chloride and vinylidene chloride, vinyl esters, such as vinyl acetate and vinyl formate and styrene and substituted styrene compounds. In the synthesis of the shell, it is also advantageous to use polyunsaturated compounds which serve as crosslinking agents. The amount of such crosslinking agents is usually 0.1 to 2% by weight, based on the sum of all comonomers. Suitable polyunsaturated compounds are, for example, allyl methacrylate, ethylene glycol dimethacrylate, diethylene glycol dimethacrylate, triethylene glycol dimethacrylate, polyethylene glycol dimethacrylate, trimethylolpropane trimethacrylate, pentaerythrityl tetramethacrylate, bis(methacryloyloxymethyl)tricyclodecane and the corresponding diacrylates, divinylbenzene, etc.

Polymers and copolymers which are composed of vinylidene chloride, acrylonitrile and (meth)acrylate monomers, and mixtures thereof, are particularly preferred.

Polyurethanes or polyurethane ureas are also suitable as wall material.

The thin shell particularly preferably consists of a copolymer of more than 75% of polyvinylidene chloride and of less than 25% of polyacrylonitrile.

Preferably, the hollow microspheres of step b) have a diameter distribution of from 1 to 200 μm, preferably from 2 to 100 μm and more preferably from 5 to 50 μm.

Preferably, at 23° C. (atmospheric pressure) less than 20%, even more preferred less than 15%, preferably less than 10%, preferably less than 5%, even more preferred less than 2.0%, preferably less than 1.0% and most preferred less than 0.5% of the volume of the cavity present in the hollow microspheres of step b) comprises a liquid (propellant, blowing agent) having a boiling point of less than 80° C., preferably less than 70° C., even more preferred less than 60° C. and most preferred less than 50° C. at atmospheric pressure.

Preferably, at 23° C. (atmospheric pressure) at least 80%, even more preferred at least 85%, preferably at least 90%, preferably at least 95%, even more preferred at least 98%, preferably at least 99% and most preferred at least 99.5% of the volume of the cavity present in the hollow microspheres of step b) comprises a gas obtained by evaporation of the liquid (propellant, blowing agent).

Preferably, the volume of all components being present in the cavity of the hollow microspheres of step b) is summing up to 100%.

Preferably, less than 20% by weight, preferably less than 15% and even more preferred less than 10% by weight of the total weight of the microspheres is the liquid (propellant, blowing agent).

The microspheres used preferably are expanded microspheres resulting in a true density of from 0.01 to 0.1 g/cm$^3$, preferably from 0.02 to 0.05 g/cm$^3$ (25° C.).

The microspheres used preferably are expanded microspheres resulting in a bulk density of from 0.005 to 0.06 g/cm$^3$, preferably from 0.01 to 0.045 g/cm$^3$ (25° C.).

In addition to the microspheres, the composition used in step b) can also contain further additives, such as dyes, synthetic tanning agents, resin tanning agents, vegetable tanning agents, polymer tanning agents like acrylic copolymers and polyurethanes, natural polymers, softening retanning agents, fatliquoring agents and dyeing auxiliaries, as well as chromium, aluminium or zirconium compounds. The composition may also contain thickening or stabilizing agents, biocides, cutting agents and other components that are customary used as formulating agents.

Preferably, the additives are polymers and thickening agents. Preferably, the ratio between hollow microspheres and additives is in the range of 5:1 to 1:20, related to the mass of the components. Especially preferred are ratios between 3:1 and 1:10.

In step b), other auxiliaries may be used prior to, simultaneously or subsequent to applying the aforementioned composition. These auxiliaries may comprise syntans like condensation products based on aromatic compounds such as for example phenol, naphthalene, phenolsulfonic acid, naphtalenesulfonic acid and formaldehyde, vegetable tanning agents like Mimosa, Tara, Quebratcho and chestnut, polymer retanning agents like acrylic copolymers of acrylic acid and natural polymers. Other auxiliaries are fatliquoring agents available as commercial products based on: animal fats like for example fish oil, lard oil or lanolin, vegetable fats like for example castor oil, coconut oil, olive oil or lecithine, synthetic fatliquors like for example chloro or sulfochloro paraffin and synthetic fatty acid esters and mineral oil. All these products are well known for a person skilled in the art.

Preferably, the composition of step b) further comprises other additives such as dyes, synthetic tanning agents, resin tanning agents, vegetable tanning agents, polymer tanning agents based on acrylate copolymers, natural polymers, softening retanning agents, fatliquoring agents and dyeing auxiliaries, as well as chromium, aluminum or zirconium compounds. The composition may also contain thickening and/or stabilizing agents, biocides, cutting agents and other components that are customary used as formulating agents.

Retanning and fatliquoring agents can be used from 0.5% up to 40% by weight of the composition. The retannage step can optionally be followed by dyeing and final fixation with for example formic acid. Among most used dyes are polyazo dyes, acid dyes, sulfur dyes and metal complex dyes.

Retanning, fatliquoring and dyeing operation running time is from 0.5 h up to 24 h when the drum is let to run all the night at a temperature of 20° C. to 60° C.

Preferably, during drying in step c) the microspheres substantially do not expand.

Preferably, after drying in step c) the hollow microspheres substantially have the same particle size distribution and/or same spherical shape as in the composition used in step b).

Preferably, after drying in step c) the hollow microspheres are substantially embedded in the leather.

The drying step c) can be carried out using conventional methods employed in tanneries like 1) vacuum drying at 45° C. up to max 65° C. for 1 s to 5 min followed by hanging at room temperature at maximum 35° C. for 2 h to up 48 h, 2) hanging and drying at room temperature at max 45° C. for 2 h up to 48 h, 3) toggling or clamped drying (the hides are stretched by use of clamps) from room temperature up to 70° C. for 2 h up to 48 h or 4) vacuum drying like described above followed by forced air conditioned drying at max 45° C.

During drying in step c) the temperature of the leather does not exceed 75° C., preferably does not exceed 70° C., even more preferred does not exceed 65° C. and most preferred does not exceed 60° C.

The leather obtained after step c) may be further processed according to customary tannery processes involving mechanical operations like staking, buffing, milling, toggling, splitting etc. and the application of a coating such comprising for example polyacrylate binders, polyurethanes, polybutadienes, casein, nitrocellulose laquers, pigments, dyes, silicones, matting agents, crosslinkers and any other components commonly used in the finishing of leather. The coating may be applied by spray application, reverse roller coating, transfer coating, curtain coating, padding etc.

In a further preferred embodiment, simultaneously or subsequent to step b) the leather is treated with retanning agents and/or dyeing agents and/or fatliquoring agents.

In a further preferred embodiment, prior to step b) the leather is treated with a retanning agent and/or dyeing agent.

A further aspect of the present invention is directed to leather obtained by the aforementioned process.

Preferably, the hollow microspheres are substantially embedded in the leather.

In a further preferred embodiment the leather is used as buffed, full-grain leather or as split leather for automotive, furniture, garment, glove, bag, aircraft, lining and/or upper leather articles.

EXAMPLES

Example 1

Hollow Microspheres Description

The expanded hollow microsphere sample used in the following examples is based on a thermoplastic copolymer of acrylonitrile and vinylidenchloride containing between 6 and 11 wt % isobutane based on solid weight as propellant or blowing agent. Supplied as a "wet cake" with a density of 0.22 g/cm$^3$ it contains 15% of dry expanded hollow microspheres having a true density of 0.04 g/cm$^3$ and a bulk density of 0.025 g/cm$^3$. The bulk density is determined by measuring the mass of a defined volume of dried powder of the microspheres according to ISO 8460, section 1 (determination of free-flow bulk-density).

The particle size of the powder version of hollow microspheres has been measured with laser light scattering using a Mastersizer 2000 apparatus from Malvern company. The average particle size D(0.5) is 20 micrometers and particle size distribution is 2.6.

An example of commercial sample of expanded hollow microspheres can be Expancel 461 WE20 from AKZO.

Expanded Hollow Microspheres Slurry

Into 750 ml deionized water containing 1.0 g of a silicone fluid defoamer like SILFORM SE 2 from Wacker Chemie AG, 200 g of expanded hollow microspheres 461 WE20 having a dry content of 15% is added under good agitation until the dispersion is homogeneous. 25.0 g of ACRYSOL ASE-60 with 28% solids acrylic swellable emulsion thickener is added into the mixing vessel continuously over a period of 20-30 minutes.

The pH of the solution is then adjusted with a 95% solution of 2-amino-2-methyl-1-propanol neutralization agent (AMP-95 from Angus Chemie GmbH) in the range 7 to 9. This causes the viscosity of the dispersion to raise to 2000 to 5000 cps (23° C.). The dispersion thus obtained is stable for several months at room temperature. Measured density of the dispersion is 0.55-0.60 g/cm$^3$ (using a picnometer).

Example 2

Unexpanded Microspheres Slurry

Into 750 ml deionized water containing 1.0 g of a silicone fluid defoamer like SILFORM SE 2 with 25% solids from Wacker Chemie AG, 45 g of unexpanded microspheres based on a copolymer of acrylonitrile and vinylidenchloride (like EXPANCEL 460 WU 400) having a dry content of 68% and a density of 1.1 g/cm$^3$ is added under good agitation until the dispersion is homogeneous. 25.0 g of ACRYSOL ASE-60 with 28% solids acrylic swellable emulsion thickener is added into the mixing vessel continuously over a period of 20-30 minutes.

The pH of the solution is then adjusted with a 95% solution of 2-amino-2-methyl-1-propanol neutralization agent (AMP-95 from Angus Chemie GmbH) in the range 7 to 9. This causes the viscosity of the dispersion to raise to 2000 to 5000 cps (23° C.). The dispersion thus obtained is stable several months at room temperature.

The measured particle size using the Mastersizer 2000 gave a particle size D(0.5) of 15 micrometers.

Example 3

Microsphere Slurry

Into 750 ml deionized water containing 1.0 g of a silicone fluid defoamer like SILFORM SE 2 with 25% solids from Wacker Chemie AG, 200 g of expanded hollow microspheres with a solid content of 15% used in example 1 is added under good agitation until the dispersion is homogeneous.

No acrylic thickener is added. The obtained dispersion has to be used immediately and can be added directly into the drum containing the leather skin.

Example 4

Formulation with Acrylic Binder Dispersion

Into 710 g of a copolymer of acrylic acid and acrylamide having 30% solids containing 1.0 g of a silicone fluid defoamer like SILFORM SE 2 with 25% solids from Wacker Chemie AG, 163 g of expanded hollow microspheres based on a copolymer of acrylonitrile and vinylidenchloride (like the one used in example 1) having a dry content of 15% is added under good agitation until the dispersion is homogeneous.

71.0 g of ACRYSOL ASE-60 with 28% solids acrylic swellable emulsion thickener is added into the mixing vessel continuously over a period of 20-30 minutes.

The pH of the solution is than adjusted with a neutralization agent (like a 20% solution of 2-amino-2-methyl-1-propanol) in the range 7 to 9. This causes the viscosity of the dispersion to raise to 2000 to 5000 cps (23° C.). The dispersion thus obtained has a solid content of 23-25%, a dry content of microspheres of 2.4%, and is stable several days at room temperature.

Example 5

Formulation with Acrylic Binder Dispersion

Into 250 g deionized water, 100 g of expanded microspheres based on a copolymer of acrylonitrile and vinylidenchloride (like the one used in example 1) having a dry content of 15% is added under good agitation until the dispersion is homogeneous. An methylmethacrylate styrene copolymer obtained with emulsion polymerization (30% solids) is than added over a period of 15-20 minutes to the mixing vessel. When homogeneous, 150 g of an emulsion based on modified lecithin (70% solids) is continuously added under agitation.

The thus obtained formulation has a total solid content of 25-26%, a dry content of microspheres of 1.5% and is stable several weeks at room temperature.

Example 6

Formulation with a Fatliquor Emulsion

Into 180 g glycerine, 120 g of an emulsion of lecithin is added continuously in 15-20 minutes under good agitation. When the mixture is homogenoeous, 380 g of a fatliquor emulsion with 50% solids based on fatty acid sulfonamide sulfosuccinate is added under good agitation followed by the addition of 100 g of expanded hollow microspheres based on a copolymer of acrylonitrile and vinylidenchloride (like that of example 1) having a dry content of 15%.

The formulation is homogeneous, has a solids content of 33-34%, 1.5% dry microspheres and is stable several weeks at room temperature.

Application on Wet Blue Hides

Example 7 (Invention)

Material 2 corresponding wet blue half hides have been used with a thickness of 1.4-1.6 mm.

Hides have been weighed. All raw material concentrations are expressed in % based on hide weight.

Retannage Process Using Formulation from Example 1 (Expanded Microspheres Slurry)

Washing and Chrome Retannage

The half hide is put into a rotating steel drum filled up with 300% water and heat up to 35° C. 0.3% formic acid (85%) is then added and the drum is allowed to rotate for 30 min. The pH of the liquor is 3.9.

The aqueous solution is then removed from the drum. 100% water is added to the drum and heated to 35° C. 4.0% Chrome 33% is added and the drum rotates for 60 min.

The float is then neutralized with 3.0% of a mixture of organic acid salts (like SELLASOL NG gran from TFL Ledertechnik) for 20 min. To obtain a pH of 4.6, 1.0% sodium bicarbonate is added within 60 min (final PH 5.0). The aqueous solution is then removed from the drum.

Retannage/Dyeing

50% water is added to the drum and heated to 35° C. 5.0% of a syntan mix of aromatic sulfone (like SELLATAN GSB liq. from TFL Ledertechnik) is added to the water and rotated for 10 min.

Dyeing is than obtained by adding 3.0% of dye (like SELLA STAR Havanna from TFL) to the drum. The drum is let to rotate for 20 min.

Then an acrylic copolymer of acrylic acid and acrylamide (MAGNOPAL PGN, from TFL Ledertechnik) is added to the mixture. The rotation time of the drum is 20 min. A pH of 5.1 has been measured.

After this step, 5.0% of the invention formulation from example 1 (microsphere slurry) is added to the drum and rotated for 90 min. The final pH is adjusted to 3.7 by adding 100% water (50° C.) and 3.0% formic acid (85%).

Washing

After these different steps, the drum is drained off and the hide is washed out with 300% hot water (50° C.) for 10 min.

Fatliquoring

A drum containing the hide prepared as described above is filled up with 100% water at 50° C. 5.0% of the formulation of example 1 (microsphere slurry) is added to the drum and let to rotate for 20 min.

Two fatliquor emulsions, for example 4.0% of a combination of a sulfated fatty acid sodium salt and lanolin fatty acid (like CORIPOL BZE from TFL), and 8.0% of a combination of sulphated and sulphonated natural and synthetic substances (like CORIPOL UFB/W from TFL) are added and the drum rotates for 40 min. The pH is set to 3.5 by adding 2.0% formic acid (85%) (The drum is running for 30 min). The aqueous solution is then removed from the drum.

Final Washing

The hide is then washed with 300% warm water (40° C.) for 10 min, followed by 300% water at 25° C. for 10 min.

The final leather is let for the night, then vacuum dried 2 min at 65° C.

Example 8

Retannage Process without Formulation According to Example 1 (Expanded Microspheres Slurry)

The leather preparation is the same as for example 7 but no microsphere slurry is added to the drum.

Results obtained with examples 7 and 8 are given in table 1.

TABLE 1

| Hide | Left Side Example 7 (invention) | Right side Example 8 (reference) |
|---|---|---|
| Thickness in backbone | 1.7-1.8 mm | 1.6 mm |
| Thickness in belly and flanks | Belly: 1.8-1.9 mm<br>Flanks: 1.9-2.1 mm | Belly: 1.6-1.7 mm<br>Flanks: 1.7-1.8 mm |
| Colour | More levelled | Flanks pronounced slightly less levelled |
| Hardness | 0 | −1/0 slightly softer |
| Tightness | +1 especially in flanks more tight | 0 |
| Fullness overall | +1 selective filling in belly and flanks | 0 Backbone similar, flanks empty |
| General | Small flanks, more tight, noticeable more fullness in loose and empty parts | Large flanks |

+2 - very good/significant difference
+1 - good/noticeable difference
0 - moderate/standard Leather evaluation showed a noticeable increase in fullness in the loose structured areas of the hide with measurable increase in substance. The leather quality with the formulation from example 1 (microspheres slurry) is more firm, more leveled and tighter in the flanks than the leather made without microspheres slurry.

The leather prepared in Example 7 was subjected to a SEM analysis (FIG. 1) to check the uniformity of particle distribution in the leather and the integrity of the hollow microspheres after the application process. The picture shows that the voids in the leather structure are uniformly filled with hollow particles and that essentially all particles retained their spherical shape and their original size.

Application on Chrome Free Automotive Hides (FOC Leather)

The aim of these trials is to evaluate the ability of the microsphere slurry of the invention, used in combination with an acrylic copolymer, to reduce or replace partly traditional syntan and fatliquor agents while maintaining the leather character and the physical properties.

Material

One automotive wet white shaved hide has been used with a thickness of 1.1 mm. Four pieces have been cut out and named example 9, example 10, example 11 and example 12.

Hides have been weighted. All raw material concentrations are expressed in % based on hide weight.

Example 9 (Reference)

Standard Leather Preparation

Washing and Neutralization

The hide is put into a rotating steel drum filled up with 200% water and heated up to 35° C. The drum is allowed to rotate for 10 min. The pH is 4.9. The aqueous solution is then removed from the drum. 100% water is added to the drum and heated to 35° C. The float is than neutralized with 6.0% of a anionic syntan based on a condensation product of phenol sulfonic acid (like SELLATAN MBS from TFL Ledertechnik) for 60 min. The pH is adjusted to 5.2 by adding 2.0% sodium formate and 0.5% sodium bicarbonate for 60 min. The aqueous solution is then removed from the drum.

Retannage/Dyeing

100% water is added to the drum and heated to 35° C. A syntan mix like 6.0% of a anionic syntan based on a condensation product of phenol sulfonic acid (like SELLATAN MBS from TFL Ledertechnik)

and 4.0% of a synthetic retanning agent based on condensed sufonated phenol (like SELLATAN RP) is added to the water and rotate for 60 min. The same syntan mix is added again and rotated for another 60 min. The leather is dyed with 2.0% SELLA FAST Grey VW-L and 0.5% SELLA FAST Beige GL for 30 min.

The pH is set to 4.0 by adding 100% water and 1.5% formic acid 85% after 60 min mixing to the mixture. The rotation time of the drum is 20 min. A pH of 5.1 has been measured.

Washing

After these different steps, the drum is drained off and the hide is washed out with 300% hot water (50° C.) for 10 min.

Fatliquoring

A drum containing the hide prepared as described above is filled up with 100% water heated to 50° C. Two fatliquors, 6.0% of a modified Leicithin emulsion (like CORIPOL ALF from TFL) and 10.0% of a fatliquor emulsion based on a long chain alcohol sulfosuccinate (50% solids like CORIPOL ESA), are added and the drum rotates for 90 min. The pH is set to 3.5 by adding 3.0% formic acid 85%, the drum running for 40 min. The aqueous solution is then removed from the drum.

Washing

The hide is washed with 300% water 25° C. for 10 min and then the water is drained off.

Fixation

300% water is added to the drum and heated up to 35° C. 0.2% formic acid (85%) is added for 10 min followed by 0.5% of a solution of a copolymer of dimethylamine epichlorhydrin (like SELLA FIX E from TFL) for 15 min. The water is subsequently drained off.

Final Washing

The hide is then washed with 300% water 25° C. for 10 min. The water is subsequently drained off.

The final leather is dried for 12 hours and subsequently vacuum dried for 2 min at 45° C.

Example 10 (Invention)

Reduced Syntan Content During Retanning Step

This is the same leather preparation as for example 9, but half of the syntan mix used during retannage step has been replaced by 6.0% of microspheres slurry from example 1 and 4.0% of an acrylic acid acrylamide copolymer (like MAGNOPAL PGN from TFL).

Retannage/Dyeing

100% water is added to the drum and heated to 35° C. 6.0% of the microspheres slurry from example 1, 4.0% of acrylic acid acrylamide copolymer, 3.0% of an anionic syntan based on a condensation product of phenol sulfonic acid (like SELLATAN MBS from TFL Ledertechnik) and 2.0% of a synthetic retanning agent based on condensed sufonated phenol (like SELLATAN RP) are added to the water and rotate for 60 min. The same syntan composition is added again and let to rotate for another 60 min. The leather is dyed with 2.0% SELLA FAST Grey VW-L and 0.5% SELLA FAST Beige GL for 30 min. The pH is adjusted to be 4.0 by adding 100% water and 1.5% formic acid 85% after 60 min mixing is added to the mixture. The rotation time of the drum is 20 min. A pH of 5.1 has been measured.

Example 11 (Invention)

Reduced Syntan Content During Retanning Step

The same leather preparation as for example 10 but the second syntan based on a synthetic retanning agent based on condensed sufonated phenol (like SELLATAN RP) has been removed and replaced by 3.0% of the first syntan based on a condensation product of phenol sulfonic acid (like SELLATAN MBS from TFL Ledertechnik).

Retannage/Dyeing

100% water is added to the drum and heated to 35° C. 6.0% of the microspheres slurry from example 1, 4.0% of an acrylic acid acrylamide copolymer (like MAGNOPAL PGN), and 6.0% of an anionic syntan based on a condensation product of phenol sulfonic acid (like SELLATAN MBS from TFL Ledertechnik) are added to the water and allowed to rotate for 60 min. 6.0% of the anionic syntan based on a condensation product of phenol sulfonic acid (like SELLATAN MBS from TFL Ledertechnik) is added again and let to rotate for another 60 min.

The leather is dyed with 2.0% SELLA FAST Grey VW-L and 0.5% SELLA FAST Beige GL for 30 min. The pH is set to 4.0 by adding 100% water and 1.5% formic acid 85% after 60 min mixing. The rotation time of the drum is 20 min. A pH of 5.1 has been measured.

Example 12 (Invention)

Reduced Fatliquor Content During Fatliquoring Step

This is the same leather preparation as for example 9 but half of the fatliquor mix used during the fatliquoring step has been replaced by 6.0% of the microspheres slurry according to example 1 and 4.0% of an acrylic acid acrylamide copolymer (like MAGNOPAL PGN from TFL).

Fatliquoring

A drum containing the hide prepared as described above is filled up with 100% water heated at 50° C. 6.0% microsphere slurry according to example 1, 4.0% of acrylic acid acrylamide copolymer (like MAGNOPAL PGN from TFL). and two fatliquors, 3.0% of a modified leicithin emulsion (CORIPOL ALF) and 5.0% of a fatliquor emulsion based on a long chain alcohol sulfosuccinate (50% solids like CORIPOL ESA), are added and the drum rotates for 90 min.

The pH is set to 3.5 by adding 3.0% formic acid 85%, the drum running for 40 min. The aqueous solution is then removed from the drum.

Leather evaluation and physical properties are given in table 2.

TABLE 2

| | Example 9 (reference) | Example 10 (invention) | Example 12 (invention) | Example 11 (invention) |
|---|---|---|---|---|
| Colour | 0 | 0+ | 0 | 0 |
| Softness | 0 Very soft | 0 | 0– | 0 |
| Tightness Milling pattern | 0 | 0– | 0+ Second best | 0+ best |
| Fullness overall | 0 | 0– Slightly more empty | 0 + 1 Full and round Second best | +1 Best |
| General | Very soft, nice | Very soft slightly less round | Surprisingly soft, round an tight very nice | Full, round, soft tight Very nice |
| Sample thickness for density | 1.5 mm | 1.5 mm | 1.6 mm | 1.5 mm |
| Tear Strenght | 37 N | 42 N | 39 N | 41 N |
| Tensile strength | 213 N 91% Elong. | 198 N 106% Elong. | 220 N 83% Elong. | 233 N 96% Elong. |
| Stitch Tear | 106 N | 105 N | 94 N | 90 N |
| Specific weight | 0.592 g/m$^3$ | 0.584 g/m$^3$ | 0.571 g/m$^3$ | 0.561 g/m$^3$ |
| Weight of sqf after milling | 885 g/m$^2$ | 873 g/m$^2$ | 911 g/m$^2$ | 839 g/m$^2$ |

+2 - very good/significant difference
+1 - good/noticeable difference
0 - moderate/standard Due to the presence of the microsphere slurry a reduction and replacement of syntan and fatliquor agents was achieved, thereby maintaining the leather character and the physical properties. Said result is surprising to the skilled artisan.

Application on Wet Blue Hides

Material

One wet blue shaved hide has been used with a thickness of 1.1 mm. Four pieces have been cut and named example 13, example 14, example 15 and example 16. Hides have been weighted. All raw material concentrations are expressed in % based on hide weight.

Example 13 (Invention)

Retannage Process Description

Washing and Chrome Retannage

The hides are put into a rotating steel drum filled up with 300% water and heated up to 35° C. 0.3% formic acid 85% is then added and the drum is allowed to rotate for 30 min. The pH of the float is 3.8-3.9. The aqueous solution is then removed from the drum. 100% water is added to the drum and heated to 35° C. 4.0% Chrome 33% is added and the drum rotates for 60 min. The float is then neutralized with 3.0% of a mixture of organic acid salts (like Sellasol NG gan TFL Ledertechnik) for 20 min. A pH of 4.6 was measured and 1.0% sodium bicarbonate was added for 60 min to obtain a final pH of 5.0. The aqueous solution is then removed from the drum.

Retannage/Dyeing

50% water is added to the drum and heated to 35° C. 6.0% of an aromatic sulfone syntan (like SELLATAN GSB liq. from TFL Ledertechnik) is added to the water and rotated for 40 min.

Fatliquoring

A drum containing the hide prepared as described above is filled up with 100% water heated at 50° C. 8.0% microspheres slurry from example 1 and 14% of a fatliquor based on a long chain alcohol sulfosuccinate (like CORIPOL MK from TFL Ledertechnik) are added to the drum and rotated for 120 min. The pH is set to 3.5 by adding 2.0% formic acid 85% and the drum is running for 30 min. The aqueous solution is subsequently removed from the drum.

Final Washing

The hide is then washed with 300% warm water (40° C.) for 10 min followed by 300% water at 25° C. for 10 min.

The final leather is let for the night than vacuum dried 2 min at 65° C., hanged dry and milled 48 hours.

The final leather articles prepared above have been finished.

Example 14 (Reference)

Leather preparation is the same as for example 13 except that no microspheres slurry has been added.

Example 15 (Invention)

Leather preparation is the same as for example 13 (containing 8.0% of microspheres slurry) except that the fatliquor has been replaced by 14.0% of a carboxylated polyamide polymer.

Example 16 (Reference)

Leather preparation is the same as for example 15 except that no microspheres slurry has been added.

All leather articles prepared above have been finished.

Finishing of leather articles from examples 13, 14, 15 and 16.

Prebase Application

One coat of Prebase is applied via Roller coater using a RRC Roller 21 SS.

The prebase is formulated as follows: 800 g of a composition made by mixing an acrylic copolymer with a polyurethane dispersion and fillers is diluted with 100 g of water. It is then added in the following order: 100 g of an polyether based polyurethane dispersion, 30 g of pigment and 20 g of an ethylene urea based crosslinker.

Application conditions are set in order to apply 3 g/sqf (square foot) wet. The hide is then rested 12 h before being milled for 2 h.

Basecoat Application

After the precoat has been applied, a basecoat is then prepared for application on the hide. The basecoat is formulated as followed.

770 parts of a compound containing an acrylic copolymer, a polyurethane dispersion, matting agent and additives is mixed with 30 g of a silica matting agent and diluted into 200 g water. 200 g of pigment compound is then added to the mixture under good agitation.

After viscosity adjustment at 25" with Cup Ford 4 (23° C.), the basecoat is applied airless in one coat of 8-10 g/sqf wet.

After drying 2 min at 80° C., the hide is let to rest for 12 h and then milled for 4 h.

Color Coat Application

Often a color coat is applied before the final topcoat. It allows to adjust the basecoat color and is slightly cross-linked. The color coat has been prepared as follows: 330 g of a matting polyurethane dispersion is mixed with 250 g of a NMP free polyether based polyurethane dispersion and 120 g of water. 50 g of a silicone additive and 110 g of pigment are added.

To this mixture, 100 g of a polyisocyanate crosslinker is added prior application. Color coat viscosity is adjusted at 25-27" Cup Ford 4 (23° C.). The color coat is applied in 1 coat of 3.0-3.4 g/sqf wet. The leather is allowed to dry 2 min at 80° C.

Topcoat Application

The topcoat is formulated as followed.

330 g of a matting polyurethane dispersion used to make the color coat is mixed with 60 g of a NMP free polyester polyether based polyurethane dispersion and 120 g of water. 90 g of a mixture of silicone additives and 5 g of pigment are added. To this mixture, 20 g of a polycarbodiimide crosslinker and 160 g of a polyisocyanate crosslinker are added prior application. Topcoat viscosity is adjusted at 25-30" Cup Ford 4 (23° C.). The topcoat is applied in 2 successive coats of 2.0-2.4 g/sqf wet. The leather is allowed to dry 2 min at 80° C. after each applications.

Leather evaluations and physical properties are given in table 3 and 4.

TABLE 3

| Crust Evaluation | Example 13 (invention) | Example 14 (reference) |
|---|---|---|
| Thickness in backbone | 1.2-1.3 mm | 1.1 mm |
| Thickness in belly and flanks | 1.2-1.3 mm | 1.0-1.1 mm |
| Colour | 0 | 0 |
| Softness | +1 | 0 |
| Milling | +1 flanks | 0 |
| Fullness overall | +1 | 0 |
| General | +1 | 0 |
| Evaluation after finishing | | |
| General | Fuller, more round | 0 |
| Filling effect in Flanks | +1 | 0 |
| Softness | 0+ | 0 |
| Thickness of sample for testing after finishing | 1.30 mm | 1.25 mm |
| Area Weight | 872 $g/m^2$ | 872.6 $g/m^2$ |
| Specific weight | 0.673 $g/m^3$ | 0.700 $g/m^3$ |
| Tear Strenght | 38 N F max | 33 N F max |
| Stitch Tear | 90 N max<br>71 N/mm | 73 N max<br>56 N/mm |
| Tensile strength | 202 N max<br>92% Elongation | 201 N max<br>80% Elongation |

+2 - very good/significant difference
+1 - good/noticeable difference
0 - moderate/standard Improvement in flank filling and milling break in the flanks with example 13.

The effect remains even after 48 hours milling. The finishing print retention was evaluated similar.

On finished quarters the filling effect was still visible.

The physical properties increased with 8.0% microspheres slurry, especially stitch tear. The specific weight is also reduced for example 13.

TABLE 4

| | Example 15 (invention) | Example 16 (reference) |
|---|---|---|
| Thickness in backbone | 1.2-1.3 mm | 1.1 mm |
| Thickness in belly and flanks | 1.2-1.3 mm<br>Strong increase in flanks | 1.0-1.1 mm |
| Colour | 0 | 0 |
| Softness | +1 | 0 |
| Milling | +1 especially in flanks more full and even milling break | 0 |
| Fullness overall | +1 | 0 |
| General | +1 | 0 |
| Finished leather | | |

TABLE 4-continued

| | Example 15 (invention) | Example 16 (reference) |
|---|---|---|
| Thickness of sample for area weight | 1.25 mm | 1.2 mm |
| Area weight | 778 $g/m^2$ | 789 $g/m^2$ |
| Specific weight | 0.625 $g/m^2$ | 0.660 $g/m^2$ |
| Tensile strenght | 201 N<br>69% Elongation | 182 N<br>83% Elongation |
| Tear strenght | 52 N | 51 N |
| Softness | 0+ | 0 |
| Milling | 0+ More regular in flanks | 0 |
| Fullness overall | +1 Especially flanks and belly part | 0 |
| General | More full in flanks | 0 |

+2 - very good/significant difference
+1 - good/noticeable difference
0 - moderate/standard A noticeable improvement in flank filling and milling break in the flanks was evaluated for example 15.

The selective filling effect remains even after 48 hours milling.

After finishing the effect of the microspheres remains still visible, especially in the flank and belly area.

Moreover, the leather according to the present invention becomes fuller, with a more regular milling in the flank and belly areas after embossing.

Vegetable Application on Light Wet Blue Hides

Reduced Vegetable Tannin Content with Microsphere Slurry Material

One wet blue shaved hide has been used with a thickness of 1.8 mm. Two pieces have been cut out and named example 17 and example 18.

Hides have been weighted. All raw material concentrations are expressed in % based on the hide weight.

Example 17 ( Invention)

Retannage Process Description

Washing

The hides are put into a rotating steel drum filled up with 300% water and heated up to 35° C. 0.5% of tetrasodium salt of ethylene diamine tetraacetic acid (like BORON ST from TFL) is then added and the drum is allowed to rotate for 30 min. The pH is 3.9-4.0. The aqueous solution is subsequently removed from the drum.

Neutralization/Retannage/Dyeing

The drum is filled up with 100% water and heated up to 35° C.

To the float 2.0% of a mixture of organic acid salts (like Sellasol NG gan TFL Ledertechnik), 2.0% of sodium formate and 4.0% of a syntan based on a neutral aromatic sulfone (like SELLATAN AG liq. From TFL) is added successively and the drum is rotated for 30 min. The pH is 4.8 after sodium formate addition and 4.9 after 30 min rotation.

Two syntans are added successively (6.0% of SELLATAN SU-V and 6.0% of SELLATAN RP) and let to rotate for 40 min. Two fatliquors are then added to the drum (2.0% of a combination of a sulfated fatty acid sodium salt and lanolin fatty acid (like CORIPOL BZE from TFL)), 2.0% of a emulsion of modified lecithin (like CORIPOL ALF from TFL) and let to rotate for 20 min.

Then 8.0% microspheres slurry from example 1 and 10% Mimosa are added to the drum and let to rotate for 60 min. The pH is 4.8.

0.5% INVADERM LU and a mixture of two brown dyes (1.0% of SELLA FAST BROWN HF-G and 2.0% of SELLA FAST BROWN HF-R) are added and rotation continues for 180 min.

Then 100% of water at 50° C. is added to the drum with 1.0% of formic acid to bring the pH at 4.0.

The drum is allowed to rotate during the night.

Next day the hides are washed with 300% water at 50° C.

Fatliquoring

A drum containing the hide prepared as described above is filled up with 150% water heated at 50° C. 4.0% of an acrylic copolymer is added and rotated for 20 min. 5.0% of a combination of a sulfated fatty acid sodium salt and lanolin fatty acid (like CORIPOL BZE from TFL) and 5.0% of an emulsion of modified lecithin (like CORIPOL ALF from TFL) are added and the drum rotates for 40 min. 2.0% of a retanning agent based on condensed sufonated phenol (like SELLATAN RP from TFL) is added and the drum rotates 20 min. 1.0% of formic acid 85% is then added followed after 20 min by 1.5% formic acid 85%. After 30 min. The final pH is 3.5. The hides are washed with 300% 35° C. hot water.

The aqueous solution is then removed from the drum.

Fixation

150% of 35° C. water is added to the drum followed by 1.0% of a solution of a copolymer of dimethylamine epichlorhydrin (like SELLA FIX E TFL). After 30 min, the hides are washed with 300% water.

The final leather is let for the night, then vacuum dried for 2 min at 60° C. and hanged dry.

Example 18 (Reference)

Leather preparation is the same as for example 17 except that instead of 6.0% of hollow microspheres slurry, 10% of vegetable extract (Quebracho tannin) has been added.

Leather evaluations and physical properties are given in table 5

TABLE 5

| Evaluation: | Example 18 (reference) | Example 17 (invention) |
|---|---|---|
| Colour/levellness | 0 | 0 |
| Fullness overall | +1 | 0 |
| Fullness flanks | +1 | +1 |
| Softness | 0+ | 0 |
| Tightness | 0 More spongy, less tight | +1 More compact |
| General | | Slightly better leather character in tightness and temper |
| Area weight | 1575 g/m$^2$ | 1488 g/m$^2$ |
| Specific weight | 630 g/m$^3$ | 588 g/m$^3$ |
| Stitch tear | 167 N | 202 N |

−2 = poor/not acceptable
−1 = unsatisfactory
0 = moderate
+1 = good
+2 = very good The aim of the trial was the direct comparison of 10% Quebracho vs. 6.0% of hollow microspheres slurry (from example 1) on corresponding low chrome tanned wet blue made with a vegetable/synthetic retanning system.

The process of the present invention leads to a leather quality, specific and area weight and stitch tear resistance being advantageous.

Examples 19 to 26

Material

Four corresponding wet blue pieces from one hide have been used with a thickness of approximately 1.0-1.1 mm.

The hides have been weighted. All raw material concentrations are expressed in % based on hide shaved weight. For all examples, the leather has been dried at 60° C.

The retannage process uses the formulation from example 1 (expanded microspheres slurry Expancel 461 WE 20 available form AKZO) in comparison with unexpanded microspheres Expancel 820 SL 40 (slurry).

Application formulation and process are the same for the two samples except weight quantities that have been varied.

Example 19

Washing and Chrome Retannage

The half hide is put into a rotating steel drum filled up with 300% water and heated up to 40° C.

0.3% formic acid 85% is then added and the drum is allowed to rotate for 20 min.

The pH of the liquor is 3.6.

The aqueous solution is then removed from the drum.

150% water is added to the drum and heated to 40° C. 3.0% of a solution of a chrome syntan (TANNESCO HN gran. from TFL Ledertechnik, with a chrome oxide content of 12%) is added and the drum rotates for 30 min.

The float is neutralized with 2.0% of sodium formate for 20 min followed by addition of 1.5% sodium bicarbonate for 60 min to obtain a final pH of 5.0.

The aqueous solution is then removed from the drum. Subsequently, the hides are washed with 200% water at 35° C. for 10 minutes.

Retannage/Dyeing

100% water is added to the drum and heated to 35° C. 3.0% of a syntan based on urea-formaldehyde condensated sulfonated phenolic resin (SELLATAN FL liq. from TFL Ledertechnik) is added to the water and rotated for 20 min.

Dyeing is then obtained by adding 2.0% of dye (like SELLA FAST Grey A TFL) to the drum. The drum is rotated for 60 min.

Subsequently fatliquoring is performed by adding 100% water at 50° C. and 14% of a long chain alcohol sulfosuccinate (CORIPOL MK from TFL).

After this step, 10.0% of the formulation according to the invention (example 1, (0.3% solid expanded microsphere) is added to the drum and rotated for 120 min. The final pH is adjusted to be 3.4 by adding 2.5% formic acid 85%.

Washing

After these different steps, the drum is drained off and the hide is washed out with 200% hot water (50° C.) for 10 min followed by a final washing with 200% water at 25° C.

Drying

The leathers were vacuum dried at 60° C. for 2 min, subsequently hang dried and staked.

Example 20

0.98% of solid expanded microspheres (Expancel 461 WE20 from AKZO) have been employed. Otherwise, the same formulation and application process as described in Example 19 above has been used.

Unexpanded Microspheres (State of the Art)

Example 21

10% of a 3% aqueous solution of unexpanded microspheres (Expancel 820 SL40 from AKZO) have been used. Otherwise, the same formulation and application process as described in Example 19 has been used.

Example 22

2.5% of a 40% aqueous solution of unexpanded microspheres (Expancel 820 SL40 from AKZO) (corresponding to 1.0% solid unexpanded microspheres) have been used. Otherwise, the same formulation and application process as described in Example 19 has been used.

TABLE 6

| | Reference | Example 19 expanded microspheres | Example 20 expanded microspheres | Example 21 unexpended microspheres | Example 22 unexpended microspheres |
|---|---|---|---|---|---|
| Solid content wt % | | 15 | 15 | 40 | 40 |
| Diameter d(0.5)[a] μm | | 20 | 20 | 13 | 13 |
| Density (g/cm$^3$) | | 0.22 | 0.22 | 1.164 | 1.164 |
| Bulk density[b] (g/cm$^3$) | | 0.027 | 0.027 | 0.475 | 0.475 |
| Leather characteristics | | | | | |
| % solids microspheres | 0 | 0.3 | 0.98 | 0.3 | 1.0 |
| Fullness | 0 | 1 | 1 | 0 | 0 |
| Belly fullness | 0 | 1 | 1.5 | 0 | 0 |
| Softness | 0 | 0 | 0.5 | 0 | 0 |
| Average thickness backbone area (mm) | 1.0-1.1 | 1.2-1.3 | 1.2-1.3 | 1.0-1.1 | 1.0-1.1 |
| Average thickness central area (mm) | 1.0-1.1 | 1.2-1.3 | 1.2-1.3 | 1.0-1.1 | 1.0-1.1 |
| Average thickness belly area (mm) | 1.0 | 1.3-1.4 | 1.4-1.5 | 1.0-1.1 | 1.0 |

+2/−2 significant difference compared with reference
+1/−1 difference compared with reference
0 reference
[a]measured with Malvern Mastersizer 2000
[b]measured according to ISO 8460 (product is 100% dried powder)

Leather Evaluation/Results:

A pronounced filling effect, especially in the belly, was found for examples 19 and 20 prepared with expanded microspheres Expancel 461 WE20 when compared to the reference without microspheres and also when compared to examples 21 and 22 treated with unexpanded microspheres Expancel 820 SL.

The leather thickness increases from 1.0-1.1 mm up to 1.4-1.5 mm in belly when 1.0% expanded microspheres Expancel 461 WE20 are used.

There is no filling effect for the piece treated with unexpanded microspheres Expancel 820SL40 when compared to non-treated leather.

Example 23

Formulation of a fatliquor emulsion containing expanded hollow microspheres Expancel 461 WE20 has been formulated into a fatliquor as follows:

Into a 3000 ml glass reactor equipped with propeller stirrer 500.0 g process oil is added. To 100.0 g of a slurry of expanded hollow microspheres (Expancel 461 WE20 from AKZO) is added under constant stirring at 25° C. successively, 20.0 g of ethoxylated (20 moles) isodecyl alcohol (from Elementis), 200.0 g of leicithin, 700.0 g deionized water and finally 20.0 g of sorbitan monooleate (Span 80 from CRODA).

A viscous brownish dispersion is obtained containing 0.97% solids hollow microspheres.

Example 24

The reference sample has been formulated like example 23 except that no microspheres have been added.

A viscous brownish dispersion is obtained.

Leather Preparation with Fatliquors Formulations of Example 23 and Example 24

Material

Two corresponding wet blue half hides have been used with a thickness of 1.4-1.6 mm.

Hides have been weighted. All raw material concentrations are expressed in based on hide weight.

Example 25 (Invention)

Retannage Process Using Formulation According to Example 23 (Expanded Microspheres Fatliquor)

Washing and Chrome Retannage

The half hide is put into a rotating steel drum filled up with 300% water and heated up to 35° C.

0.3% ethoxylated sulfated fatty alcohol (Borron SAF from TFL Ledertechnik) and 0.3% formic acid 85% is then added and the drum is allowed to rotate for 20 min. The pH of the liquor is 3.3.

The aqueous solution is then removed from the drum and the hide is neutralized as follows: 100% water is added to the drum and heated up to 35° C.

To the float 2.0% of sodium formate and 2.0% a mixture of organic acid salts (like SELLASOL NG gran from TFL Ledertechnik) is then added for 20 min to obtain a pH of 4.9. Finally, 0.5% sodium bicarbonate is added and the drum is rotated for 60 min (final pH 5.3).

The aqueous solution is then removed from the drum. The hide is washed with 300% water at 35° C. for 10 minutes.

Retannage

50% water is added to the drum and heated to 35° C. 5.0% of a syntan mix of a retanning agent based on condensed sufonated phenol (like SELLATAN RP from TFL Ledertechnik) is added to the water and rotated for 40 min. 200% water is then added and rotated for 60 min. The pH is adjusted to 4.5 with 1.0% formic acid. The hide is washed with 300% water at 50° C. for 10 minutes.

Fatliquoring

200% water is added to the drum at 50° C. and subsequently 15% of fatliquor emulsion from example 23 is added. The drum is let to rotate for 120 min. After this treatment step the final pH is 4.0 and adjusted to be 3.6 (adding of 1.0% formic acid for 25 minutes).

Washing

After these different steps, the drum is drained off and the hide is washed out with 200% water (25° C.) for 10 min.

The final leather is stored for 12 hours at room temperature and subsequently vacuum dried for 2 min at 60° C.

Example 26 (Reference)

Retannage Process Using Formulation from Example 24 (Fatliquor without Expanded Microspheres Fatliquors)

Washing and Chrome Retannage

The half hide is put into a rotating steel drum filled up with 300% water and heated up to 35° C.

0.3% ethoxylated sulfated fatty alcohol (Borron SAF from TFL Ledertechnik) and 0.3% formic acid 85% is then added and the drum is allowed to rotate for 20 min. The pH of the liquor is 3.3.

The aqueous solution is then removed from the drum and the hide is neutralized as follows: 100% water is added to the drum and heated up to 35° C.

To the float 2.0% of sodium formate and 2.0% a mixture of organic acid salts (like SELLASOL NG gran from TFL Ledertechnik) for 20 min is added to obtain a pH of 4.9. Finally, 0.5% sodium bicarbonate is added and the drum is rotated for 60 min (final pH 5.3).

The aqueous solution is then removed from the drum. The hide is washed with 300% water at 35° C. for 10 minutes.

Retannage

50% water is added to the drum and heated to 35° C. 5.0% of a syntan mix of an retanning agent based on condensed sufonated phenol (like SELLATAN RP from TFL Ledertechnik) is added to the water and rotated for 40 min. 200% water is then added and rotated for 60 min. The pH is set to 4.5 with 1.0% formic acid. The hide is than washed with 300% water at 50° C. for 10 minutes.

Fatliquoring

200% water is added to the drum at 50° C. Then 15% of fatliquor from example 24 (fatliquor emulsion without hollow microspheres) is added. The drum is rotated for 120 min. The final pH is 4.0 after this treatment and adjusted to be 3.6 by adding 1.0% formic acid for 25 minutes.

Washing

After these different steps, the drum is drained off and the hide is washed out with 200% water (25° C.) for 10 min.

The final leather is stored for 12 hours at room temperature and subsequently vacuum dried for 2 min at 60° C.

Results

Leather that has been treated with the fatliquor containing expanded microspheres (example 23) has a much better fullness compared with the leather treated with the fatliquor not containing microspheres (example 24).

TABLE 7

| | Example 23 (with microspheres) | Example 24 (without microspheres) |
|---|---|---|
| Colour | 0 | 0 |
| Touch | Slightly Silky | Slightly silky |
| Softness | +1 | +1 |
| Fullness | +1 | 0 |
| Tightness | 0 | 0 |
| Filling/softening/ retanning Effect | +1 Softening/ retanning | +1 |
| Exhaustion after acidification | 0 Milky Almost no microspheres visible | 0 Milky |

−2 = poor/not acceptable/strong difference
−1 = unsatisfactory/noticeable difference
0 = moderate/standard
+1 = good/noticeable difference

The invention claimed is:

1. A process for retanning leather comprising the steps of:

a) providing tanned or pre-tanned leather, b) treating the tanned or pre-tanned leather of step a) with a composition comprising expanded hollow microspheres having a true density of from 0.01 to 0.10 g/cm$^3$ (25° C.) and/or a bulk density of a dry powder of the expanded hollow microspheres of from 0.005 to 0.06 g/cm$^3$ (25° C.), and c) drying, whereby a temperature of the leather during drying does not exceed 75° C.

2. The process according to claim 1, wherein in step b) an amount of expanded hollow microspheres used is 0.05 to 1.0% by weight, based on a dry weight of the leather.

3. The process according to claim 1, wherein the composition of step b) is an aqueous composition having a solid content of expanded hollow microspheres from 0.5 to 15% by weight.

4. The process according to claim 1, wherein the expanded hollow microspheres of step b) have a diameter of from 1to 200 μm.

5. The process according to claim 1, wherein at 23° C., less than 10% of the volume of a cavity present in the expanded hollow microspheres of step b) comprises a liquid (propellant) having a boiling point of less than 80° C. at atmospheric pressure.

6. The process according to claim 1, wherein during drying in step c) the expanded hollow microspheres do not further expand.

7. The process according to claim 1, wherein after drying in step c) the expanded hollow microspheres have a same particle size distribution and/or same spherical shape as in the composition used in step b).

8. The process according to claim 1, wherein after drying in step c) the expanded hollow microspheres are embedded in the leather.

9. The process according to claim 1, wherein drying in step c) is carried out from 1s to 48 h.

10. The process according to claim 1, wherein during drying in step c) the temperature of a surface of the leather does not exceed 80 ° C.

11. The process according to claim 1, wherein the composition of step b) further comprises one or more additives selected from the group consisting of dyes, synthetic tanning agents, resin tanning agents, vegetable tanning agents, polymer tanning agents based on acrylate copolymers, natural polymers, softening retanning agents, fatliquoring agents, dyeing auxiliearies, chromium compounds, aluminium compounds, and zirconium compounds.

12. The process according to claim 11, wherein prior, simultaneously or subsequent to step b) the leather is treated with retanning agents and/or dyeing agents and/or fatliquoring agents.

13. The process according to claim 1, wherein the composition of step b) further comprises a retannage agent and/or dyeing agent.

14. The process according to claim 13, wherein subsequent to step b) the leather is washed and treated with a fat liquoring agent.

15. The process according to claim 1, wherein the composition of step b) further comprises a fat liquoring agent.

16. The process according to claim 15, wherein prior to step b) the leather is treated with a retanning agent and/or dyeing agent.

17. A leather obtained by the process according to claim 1.

18. The leather according to claim 17, wherein the expanded hollow microspheres are embedded in the leather.

19. A buffed or full-grain leather, or a split leather for automotive, furniture, garment, glove, bag, aircraft, lining and/or upper leather articles comprising the leather of claim 17.

20. The process according to claim 1, wherein in step b) the composition comprising the expanded hollow microspheres is an aqueous composition.

21. The process according to claim 4, wherein the expanded hollow microspheres of step b) have a diameter of from 2 to 100 μm.

22. The process according to claim 4, wherein the expanded hollow microspheres of step b) have a diameter of from 5 to 50 μm.

* * * * *